United States Patent [19]

McQuillen, Jr.

[11] Patent Number: 4,541,553

[45] Date of Patent: Sep. 17, 1985

[54] INTERLOCKING COLLECTOR NOZZLE ASSEMBLY FOR POURING MOLTEN METAL

[75] Inventor: Albert L. McQuillen, Jr., Pittsburgh, Pa.

[73] Assignee: Servsteel, Inc., Houston, Pa.

[21] Appl. No.: 533,998

[22] Filed: Sep. 20, 1983

[51] Int. Cl.[4] ..... B22D 37/00

[52] U.S. Cl. ..... 222/591; 222/594; 222/606; 222/566; 106/104

[58] Field of Search ..... 222/591, 594, 600, 606, 222/561, 566, 598; 106/104

[56] References Cited

U.S. PATENT DOCUMENTS

| | | | |
|---|---|---|---|
| 3,395,840 | 8/1968 | Gardner | 222/591 |
| 3,712,518 | 1/1973 | Meier | 222/600 |
| 3,841,539 | 10/1974 | Shapland, Jr. et al. | 222/561 |
| 4,314,659 | 2/1982 | Shapland | 222/598 |

FOREIGN PATENT DOCUMENTS

| | | | |
|---|---|---|---|
| 1905995 | 9/1969 | Fed. Rep. of Germany | 222/591 |
| 2081431 | 2/1982 | United Kingdom | 222/591 |
| 0833797 | 5/1981 | U.S.S.R. | 106/104 |

*Primary Examiner*—F. J. Bartuska
*Assistant Examiner*—Nils E. Pedersen
*Attorney, Agent, or Firm*—Buell, Ziesenheim, Beck & Alstadt

[57] ABSTRACT

A collector nozzle assembly for pouring molten metal is assembled from upper and lower nozzle portions to form a continuous nozzle. The abutting end surface of one nozzle portion is provided with a projection and the abutting end surface of the other nozzle portion is provided with a complementary groove with said projection received snugly by said groove and cemented thereinto. A metal housing is cemented around the exterior of said nozzle assembly with mortar which is heat set at a temperature no higher than 800° F.

2 Claims, 6 Drawing Figures

INTERLOCKING COLLECTOR NOZZLE ASSEMBLY FOR POURING MOLTEN METAL

Figure 1:
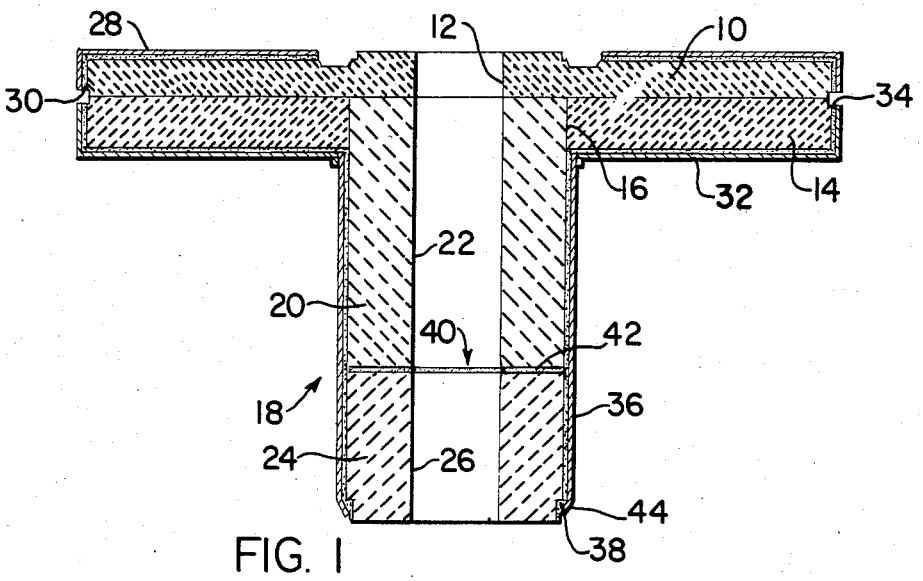

This invention relates to an improved collector tube assembly for use with slidable gate valves to control the flow of liquid metal from a ladle to an ingot mold or some other vessel.

It is known to form the collector tube extending downwardly from slidable gate valves of two tubes continuous with each other, each comprising a distinctive refractory material. The refractory constituting the upper tube portion which is closest to the gate must be sufficiently erosion resistant to withstand the erosive effect due to oblique impingement of throttled liquid emerging from the gate. High alumina refractories are useful for this purpose. The high alumina refractories have high thermal conductivities, making them less useful for the bottom portion of the collector tube remote from the gate where excessive cooling of the flow liquid can lead to some solidification of the emerging melt. A refractory of lower alumina content can be employed at the discharge end of the collector tube where the lower thermal conductivity of such a refractory makes it desirable in spite of its greater tendency to erode.

The two refractories can be cemented at their abutting end surfaces on a plane transverse to the tube bore to constitute a continuous collector tube. However, any jarring of the elongated two-piece assembled tube during shipping or handling tends to break the mortar cementing the tube portions together. This breakage or fracturing can be particularly unsafe if it is hidden and undetected, because it can constitute a channel through which hot melt can escape and spray upon an operator during use.

U.S. Pat. No. 3,841,539 to Shapland, Jr. and Shapland relates to the detachability and replacement in the field of the downstreammost portion of the collector nozzle, i.e., the tip portion. Specifically, the Shapland patent teaches a "removable and replaceable tip" for the intentional removal of the tip portion of the collector tube between the pouring of melts by using nonpermanent attachment of the tip to the collector tube proper, which is nearest the gate. The Shapland patent employs mechanical means to accomplish the detachability of the tip portion from the collector nozzle, including an openable metal band, spring clips and screw threads.

The present invention marks a sharp departure from the Shapland teaching. The nozzles of the present invention are particularly intended for use with one melt only, and therefore are not constructed for field detachability of the nozzle tip portion. Rather than detach and replace the tip portion after use with a single melt, it is intended to remove the entire nozzle assembly to a shop for a complete refurbishing job. In contrast to the approach of the Shapland patent, it is the purpose of the present invention to provide a collector tube assembly which is especially resistant to detachment or disassembly, having enhanced immunity against disturbing the integrity of the attachment of the collector tip portion to the main collector tube.

In the Shapland collector nozzle assembly, the tip portion has a larger outside diameter than the collector tube proper. Thereby, some of the end surface of the tip facing the collector tube proper does not have a complementary facing surface on the collector tube proper to which it can be cemented. In the nozzles of the present invention, the complementary facing surfaces of the tip portion and the collector tube proper are modified to provide an enhanced cementing surface area between the two members, and the exterior cylindrical surfaces of the tube members are flush with respect to each other. The surface modification involves shaping the butt end surface of one refractory to be partially or entirely nonlinear (non-flat) to define a projection and also shaping the complementary butt end surface of the other refractory to be partially or entirely nonlinear (non-flat) to define a complementary depression or groove so that said projection can be fitted snugly into said groove. These projections and corresponding grooves preferably can extend along the entire circle of the butt end of each tube wall to form a non-ending interlock. The resulting interlocking joint is snug, secure and compact, guarding the members against relative lateral movement. When the butt ends of the nozzle tubes are joined and secured together with cement, the interlocking joints provide an enlarged adhesion area over which the cement can function as compared to the adhesion area provided by flat butting surfaces without an interlocking joint. Nonlimiting examples of types of joints that may be employed include dovetail, chevron, ship-lap, semi universal and tongue and groove joints.

The interlocking joints of this invention not only provide enhanced bonding areas between the two nozzle portions, but also provide increased margins of safety for operators in case of failure of the cement bond. In the event of localized fracture of the cement bond due to erosion, thermal or mechanical stresses, the lock joint requires the melt to traverse a greater lateral distance before it can escape laterally from the collector tube, thereby delaying or avoiding such escape. In addition, the lock joint requires laterally escaping melt to flow through an uphill region before, reaching the exterior of any nozzle portion, thereby providing a damming effect to delay or avoid such escape.

This invention will be more particularly described by reference to the figures wherein:

FIG. 1 shows a slidable gate valve with a collector tube having linear abutting surfaces, unimproved by the present invention, and FIGS. 2 to 6 show collector tube fragments modified with respect to FIG. 1 only by having a nonlinear interlocking joint assembly of this invention.

The numerical designations used for elements of FIG. 1 apply similarly to shown and unshown corresponding parts of FIGS. 2 to 6. FIG. 1 shows a refractory gate valve-nozzle assembly which can be used to pour molten metal from an overhead ladle, not shown, to an ingot mold or some other vessel, also not shown. The assembly can be used to control and direct the flow of ferrous and non-ferrous metals.

The gate portion of the assembly includes a fixed top plate 10 having a central cylindrical bore 12 and a laterally slidable surface plate 14 having a much larger central cylindrical bore defined at 16. A nozzle 18 comprises a relatively long upper nozzle portion proper 20 having a central cylindrical bore 22 and a relatively short lower nozzle portion 24 having a cylindrical central bore 26.

The central gate bore 12 is of the same diameter as the central bores 22 and 26 of the two collector nozzle elements. This minimizes erosion caused by the flowing melt. FIG. 1 illustrates the gate in a fully open position to allow full flow of melt through the collector nozzle assembly. The gate can be entirely or partially closed by sliding plate 14 and attached nozzle assembly 18 laterally to disalign bore 22 with respect to bore 12.

Fixed top plate 10 is provided with a metal housing 28 which is cemented to the top plate by means of mortar 30. Sliding surface plate 14 is provided with a separate metal housing 32 which is cemented thereto by means of mortar 34. The nozzle assembly 18 is provided with a metal housing 36 which is cemented thereto by means of mortar 38. Metal housing 36 helps to vertically support refractory member 24.

Nozzle members 20 and 24 are of different refractory materials. Member 20 can be a relatively high alumina refractory for greater resistance to erosion while member 24 can be a relatively low alumina refractory for reduced thermal conductivity. As shown in FIG. 1, the two nozzle refractories abut each other with entirely flat surfaces along their entire butting interface as indicated at 40 and are cemented together by means of mortar 42. The abutting surfaces at 40 provide a minimum butting area over which the cementing action of mortar 42 can be exerted and does not represent an embodiment of this invention.

FIGS. 2, 3, 4, 5 and 6 show dovetail, chevron, shiplap, semi universal and tongue and groove interlocking joints, respectively, which are embodiments of this invention, in place of the flat butt joint 40 of FIG. 1. The interlocking joints of FIGS. 2, 3, 4, 5 and 6 are each secured by cement. It is readily apparent by observation that the joints of FIGS. 2, 3, 4, 5 and 6 each provide a considerably enlarged area of contact between the two nozzle members to enhance the cementing area and thereby strengthen the adhesive seal between the two nozzle members, as compared to the embodiment of FIG. 1. In addition, the interlocking joints of FIGS. 2, 3, 4, 5 and 6 increase the total distance of travel required for the lateral escape of melt and also require regional uphill travel for lateral escape to occur, thereby tending to provide a damming effect against such escape. Regions of uphill travel are indicated at 46 in FIG. 2, 48 in FIG. 3, 50 in FIG. 4, 52 in FIG. 5 and 54 in FIG. 6. Both of these effects enhance operator protection against spraying of melt caused by a partial failure of the seal between the collector nozzle portions. Generally, the layers of cement used throughout the figures are about ⅛ to 1/16 inch thick.

Figure 2:
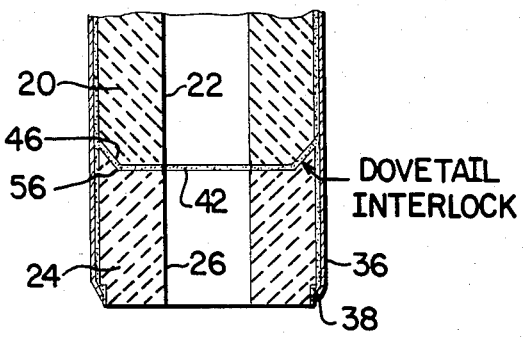
Figure 3:
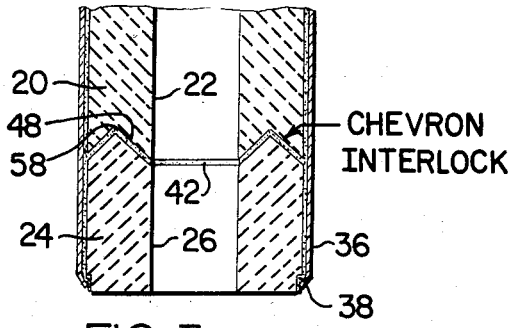
Figure 4:
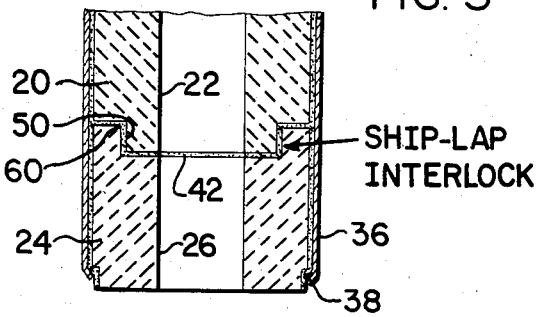
Figure 5:
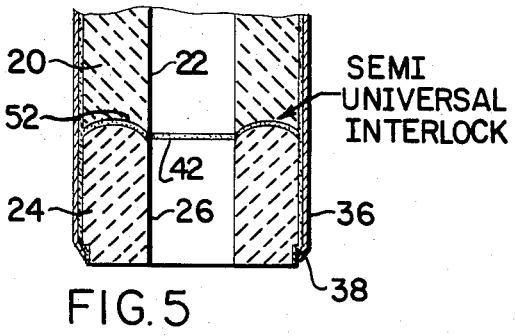
Figure 6:
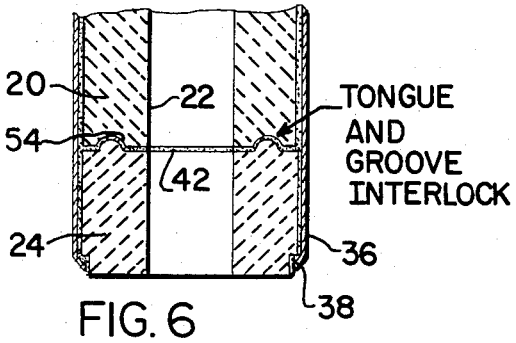

The lock joint configurations of FIGS. 2, 3 and 4 provide sharp angle projections and grooves, as indicated at 56, 58 and 60, respectively, thereby imparting a positive guard against lateral movement of the nozzle members when they are urged against each other. The nozzle walls must be sufficiently thick to accommodate such projections and grooves as internal constructs within the wall.

Since the outside diameters of the upper and lower nozzle portions 20 and 24 are equal, the outer cylindrical surfaces of the two nozzle portions are flush with respect to each other. Thereby, the attachment of lower member 24 to upper member 20 can be assisted by means of metal housing 36 and the cementing mortar 38. Because metal housing 36 comprises an unbroken, straight, continuous cylindrical unit over its entire length, it provides a brace for nozzle portions 20 and 24. In addition, housing 36 is provided with an indentation or collar 44 at the bottom of nozzle portion 24 which tends to support the weight of nozzle portion 24 and to minimize tensile stresses on the mortar 42 at the joint due to the weight of bottom nozzle portion 24. Such tensile stresses could be particularly hazardous when the mortar at the lock joint is undergoing erosion by the flowing melt. It is noted that the mortar is more subject to erosion than the refractory.

The use of metal housing 36 requires special precautions during fabrication and use of the nozzle assembly. While metal housing 36 provides a cooperative effect with respect to the mortar at the lock joint, it is to be noted that the housing prevents inspection of the mortar at the lock joint when the nozzle is in use. Furthermore, the metal of the housing has a much higher thermal coefficient of expansion than the refractory, requiring the housing to be protected against distortion which would occur at the high temperatures required for setting many cements when the nozzle assembly is being fabricated. Therefore, the mortar used in securing the metallic housing to the nozzle wall and which can also be used in fabricating the interlocking joint and any other parts of the assembly of this invention is of a type which can be heat-set by placing the entire assembly upon fabrication in an oven or furnace at a temperature no higher than 800° F., preferably no higher than 700° F. and most preferably no higher than 600° F. Phosphate-treated mortars, such as a phosphate bonded alumina mortar, are of a type which can set at these low temperatures. Such mortars are contrasted to conventional hydraulic mortars which require temperatures near 1400° F. for heat-setting. While the metal housing will severely buckle at temperatures near 1400° F., it will not be damaged at temperatures up to 800° F. Because metal housing 36 is insulated by the refractory from the high temperatures of the flowing melt during use the metal housing will not experience temperatures as high as the above-mentioned oven mortar set temperatures during use.

The low temperature set mortars have the further advantage that they are relatively volume stable under the elevated temperatures of use as compared to mortars which require higher temperatures for setting. This is a considerable advantage since severe expansion and contraction effects in the mortar at the lock joint could induce fissures in the mortar leading to seepage and escape of the melt, thereby tending to nullify the structural advantages described above.

I claim:

1. A collector nozzle for pouring molten metal comprising upper and lower nozzle portions of substantially equal outside diameters, said nozzle portions comprising different refractory materials and having abutting end surfaces in contact to form a continuous nozzle length, the abutting end surface of one of said nozzle portions being nonlineal to define a projection and the abutting end surface of the other of said nozzle portions being nonlineal to define a complementary groove with said projection extending into and snugly received by said groove, said projection and groove cemented together to secure an interlocking joint with a mortar which has been heat set at a temperature no higher than 800° F., said nozzle being cylindrical and including a cylindrical metal housing secured around the exterior thereof.

2. A collector nozzle for pouring molten metal comprising upper and lower nozzle portions of substantially equal outside diameters, said nozzle portions comprising different refractory materials and having abutting end surfaces in contact to form a continuous nozzle length, the abutting end surface of one of said nozzle portions being nonlineal to define a projection and the abutting end surface of the other of said nozzle portions being nonlineal to define a complementary groove with said projection extending into said snugly received by said groove, said projection and groove cemented together to secure an interlocking joint with a phosphate bonded alumina mortar.

* * * * *